US007481336B2

(12) United States Patent
Arghyris et al.

(10) Patent No.: US 7,481,336 B2
(45) Date of Patent: Jan. 27, 2009

(54) MANUALLY-ACTUATED METERING PUMP

(75) Inventors: Laurent Arghyris, Boege (FR); Patrice Puviland, La Roche sur Foron (FR); Jean-Philippe Taberlet, Villard (FR)

(73) Assignee: Lablabo, Annemasse (FR)

( * ) Notice: Subject to any disclaimer, the term of this patent is extended or adjusted under 35 U.S.C. 154(b) by 222 days.

(21) Appl. No.: 10/538,362

(22) PCT Filed: Nov. 15, 2003

(86) PCT No.: PCT/FR03/03725

§ 371 (c)(1),
(2), (4) Date: Jun. 13, 2005

(87) PCT Pub. No.: WO2004/054721

PCT Pub. Date: Jul. 1, 2004

(65) Prior Publication Data

US 2006/0249540 A1 Nov. 9, 2006

(30) Foreign Application Priority Data

Dec. 13, 2002 (FR) ..... 02 15854

(51) Int. Cl.
*B65D 88/54* (2006.01)

(52) U.S. Cl. ..... 222/321.7; 222/95; 222/105; 222/380; 222/491; 222/494

(58) Field of Classification Search ..... 222/380, 222/385, 95, 105, 321.7, 491, 321.9, 494, 222/383.1, 207
See application file for complete search history.

(56) References Cited

U.S. PATENT DOCUMENTS

| | | | | | |
|---|---|---|---|---|---|
| 3,406,909 | A | * | 10/1968 | Preiffer | 239/333 |
| 4,662,544 | A | | 5/1987 | Gillispie | |
| 4,723,694 | A | * | 2/1988 | Sykes | 222/518 |
| 5,271,432 | A | * | 12/1993 | Gueret | 137/854 |
| 5,271,513 | A | * | 12/1993 | Crosnier et al. | 215/320 |
| 5,339,972 | A | * | 8/1994 | Crosnier et al. | 215/320 |
| 5,409,146 | A | * | 4/1995 | Hazard et al. | 222/321.8 |
| 5,518,377 | A | * | 5/1996 | Bougamont et al. | 417/446 |
| 5,617,976 | A | * | 4/1997 | Gueret | 222/380 |
| 5,926,953 | A | | 7/1999 | Behar | |
| 6,070,763 | A | * | 6/2000 | Gueret | 222/95 |
| 6,354,469 | B1 | | 3/2002 | Pozzi | |

FOREIGN PATENT DOCUMENTS

| | | |
|---|---|---|
| EP | 0 538 162 | 4/1993 |
| EP | 0 733 559 | 9/1996 |
| EP | 0 747 292 | 12/1996 |
| FR | 2 785 878 | 5/2000 |
| FR | 2 813 863 | 3/2002 |
| WO | 95/00195 | 1/1995 |

* cited by examiner

*Primary Examiner*—Frederick C. Nicolas
(74) *Attorney, Agent, or Firm*—Crowell & Moring

(57) ABSTRACT

The invention relates to a manually-actuated metering pump of simple design, which is intended for a rigid container. The inventive metering pump is of the dual valve type, comprising a lower inlet valve and an upper ejection valve which are disposed at the input and output respectively of a metering chamber which is slidably mounted on the lower valve. Moreover, said lower valve is fixed to a hollow tube which communicates with the inside of the container. The invention can be used for dispensing fluid products.

7 Claims, 5 Drawing Sheets

MANUALLY-ACTUATED METERING PUMP

CROSS-REFERENCE TO RELATED APPLICATIONS

This application is a §371 application of International Patent Application No. PCT/FR2003/003725, filed Nov. 15, 2003, and published in French on Jul. 1, 2004, as International Publication No. WO 2004/054721 A1, which claims priority to French Patent Application No. 02/15854, filed Dec. 13, 2002. The disclosures of these applications are incorporated herein in their entirety.

BACKGROUND OF THE INVENTION

1. Field of the Invention

The present invention relates to a metering pump for dispensing fluid, liquid or pasty products, and more particularly to a manually actuated metering pump for a rigid bottle having a flexible pouch or a piston and dip tube, containing a fluid, liquid or pasty product intended to be delivered in constant individual doses, and to a dispensing device equipped with such a pump.

2. Description of the Related Art

The operating principle of metering pumps for dispensing fluid, liquid or pasty products is well known. These pumps are mounted on a bottle containing the product to be dispensed and are formed from a metering chamber of defined volume, a piston capable of moving in the chamber under the action of a pusher, and at least two valves. The lower valve, or intake valve, located at the inlet of the chamber and controlling the communication with the inside of the bottle, is closed when the pusher is pushed right in, while the lower valve, at the outlet of the chamber, is open, allowing the product expelled from the chamber by the displacement of the piston to pass, and then, when the pusher is released, the piston rises back up in the chamber under the action of a spring, the upper valve closes, while the lower valve opens, making it possible to fill the chamber for the purpose of dispensing a new dose of product.

This mode of operation means that air can be introduced into the bottle to make up for the volume released by the product expelled from the bottle and can allow the metering chamber to be uniformly filled at each actuation of the pusher.

To package and dispense products that have to be kept away from air, especially in the field of pharmaceutical and cosmetic products, devices are known that generally comprise a container with a rigid shell in which a piston moves, said piston pushing the product toward the inlet orifice in the metering chamber and isolating it from the air that penetrates above the piston. Also known are devices with a rigid container in which a flexible pouch is placed, said pouch retracting progressively as the product is extracted therefrom. The product remaining in the pouch is kept away from air, whereas the expulsion of the product out of the pouch can be achieved by means of an airless pump, or under the pressure of a propellant gas that acts on the wall of the pouch, inside the bottle.

In the case of expulsion of the product from the pouch by means of an airless pump, a vent is provided, generally in the bottom or in the neck of the bottle, in order to allow external air to enter into the space lying between the bottle and the pouch at each actuation of the pump, and thus to allow the pouch to retract while maintaining sufficient pressure on its walls. One illustrative example according to this technique is disclosed in patent FR 2 723 356 relating to a device that includes a flexible plastic pouch, such as one made of polyethylene or polypropylene, in a rigid container whose neck includes an air inlet.

The pumps must provide good sealing and be able to operate both in a vertical position and in an inclined position. Patent FR 2 669 379 discloses a metering pump that ensures good sealing even in the situation when there is a change of position, of the type with an axial piston, carrying a sliding floating piston, having three valves. Patent FR 2 726 810 discloses an example of an airless pump in which the lower valve is flexible and frustoconical, while the upper valve is carried by a disk placed at the base of the hollow stem of the pusher. However, pumps of this type have the drawback of comprising a relatively large number of components, which weakens them and increases their manufacturing cost.

Patent EP 0 538 162 discloses a closure device for a bottle, one variant of which includes a hollow pusher forming a metering chamber, between an output valve and an intake valve; when the pusher is actuated, the base of the part forming the lower valve is pushed back and deforms, therefore making it easier for the truncated cone surrounding the axial cylindrical part to open, which runs the risk of causing fluid to return into the bottle. Patent application WO 95/25945 relates to a pump that includes a deformable lower valve and an expulsion valve, the orifice of which is similar, but the dimensions and the functions of which are different. Other examples of dispensing bottles with a hollow pusher are disclosed in patents EP 888 823 and EP 733 559. In all these dispensing bottles, the valves have different shapes, dimensions and functions.

SUMMARY OF THE INVENTION

The subject of the present invention is an airless metering pump for dispensing fluid, liquid or pasty products, which has a small number of components.

The subject of the present invention is also an airless metering pump for uniform dispensing of constant individual doses of fluid, liquid or pasty products.

The subject of the invention is also a device for packaging and dispensing fluid, liquid or pasty products, of the type consisting of a rigid bottle with a flexible pouch, comprising a metering pump as described above, which ensures satisfactory operation irrespective of the position of the rigid bottle.

The subject of the invention is also a device for packaging and dispensing fluid or liquid products of the type consisting of a rigid bottle with a vent, comprising a metering pump as described above, sealably mounted on a bottle provided with a vent.

According to the present invention, the manually actuated metering pump, for a rigid bottle, is of the double-valve type, comprising an intake lower valve and an expulsion upper valve at the inlet and at the outlet, respectively, of a metering chamber that is mounted so as to slide on the lower valve, and is noteworthy in that the lower valve and the upper valve are identical.

BRIEF DESCRIPTION OF THE FIGS. OF THE DRAWING

FIG. 1 of the Drawing is a schematic sectional view of a pump mounted on the neck of a rigid container;

FIGS. 2*a* and 2*b* of the Drawing are a partial sectional view of a device for dispensing fluid, liquid or pasty products;

FIGS. 3*a* and 3*b* show a partial sectional view of an alternative version of the device of FIG. 2;

FIGS. 4*a* and 4*b* show a partial sectional view of another alternative version of the device of FIG. 2;

DETAILED DESCRIPTION OF THE PREFERRED EMBODIMENTS

Figure 1:
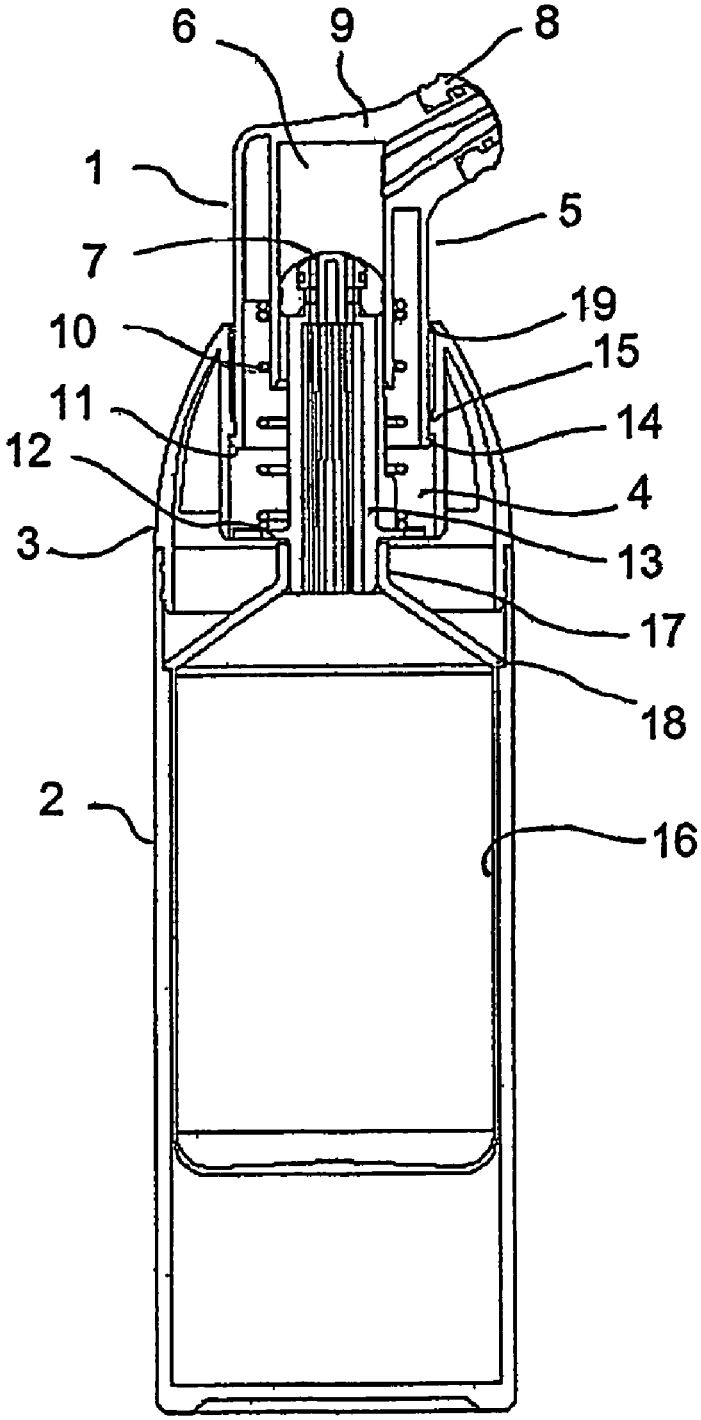

According to a preferred embodiment of the invention, the lower valve is fixed to a hollow tube that communicates with the pouch, while the upper valve is mounted on the end of the outlet nozzle of the pump. This embodiment has the advantage of constituting an outermost closure that completely eliminates the product dead volume at the outlet of the pusher, thereby making it easier to preserve said product and avoid any unsightly accumulation of product at the outlet of the pusher which could, by drying out, block the output nozzle.

The lower valve, on which the pump chamber slides, acts as a piston, thereby simplifying the manufacture of the pump.

According to another preferred feature of the invention, the two valves, namely the lower and upper valves, are identical and interchangeable when mounting the device, which considerably simplifies its manufacture and greatly reduces its cost.

According to one simple and inexpensive embodiment, the valves are formed by a cylindrical cover made of an elastic material pierced at its center and fixed to a cylindrical part forming a support and comprising an annular orifice surrounding, at its center, an element facing the hole in the cover and masking the latter. At rest, the front wall of the cover covers the annular orifice and bears on the central element. Thus, the valve is closed. An external overpressure presses the wall of the cover against its support and therefore keeps the valve closed. In contrast, an internal overpressure causes the elastic blade of the front wall of the cover to rise, exposing the annular orifice and causing the valve to open.

According to one preferred embodiment of the invention, the valves are of cylindro-conical shape, comprising a dome pierced at its center, the wall of which, in the closure position, covers the annular orifice outlet nozzle in a plane perpendicular to the outgoing flow of fluid. More particularly, the wall of the valve, in its domed portion, covers the annular orifice, substantially perpendicularly to its axis, and bears on the cylindrical central element lying along the axis of the orifice. This arrangement makes it possible to combine the valve with an orifice of relatively large cross section both as regards the intake lower valve and the expulsion upper valve.

The valves may be made of any material exhibiting the desired flexibility and elasticity properties and compatible with the products contained in the bottle. As an example, it is possible to use valves made of natural or synthetic rubber or made of thermoplastic elastomers, such as thermoplastic polyesters, polyurethanes or SBS, or even silicones.

According to one advantageous embodiment of the present invention, the valves are made of a material having a Shore A hardness of between 40 and 80, preferably between 50 and 60.

According to the invention, it may be advantageous to mount the pump sealably on the rigid bottle via a ring or a cap. According to a variant, the pump is mounted directly on the bottle, for example by snap-fitting.

According to one advantageous embodiment, the pusher includes means for limiting its travel and for adapting the dose to a predefined volume. These means may be produced by providing, for example, one or more stops placed on the moving portion of the pusher and co-operating with complementary means on the fixed portion, or by varying the length of the cylindrical portion of the pusher, or else by inserting a sleeve that limits the stroke of the pusher on the support. It is thus possible to have devices for dispensing fluid products that are designed to provide different doses of product, by only modifying a single constituent element, or by inserting a simple complementary element. Such a system is particularly inexpensive.

An air inlet circuit is provided so that the external air can enter the bottle and compensate for the volume of product expelled by the pump.

In the case of a device of the type consisting of a rigid bottle with a flexible pouch, the external air must reach the space separating the flexible pouch from the inner wall of the rigid bottle in order to maintain sufficient pressure therein so that the pouch can retract at each expulsion of product. This air circuit is preferably located level with the pusher of the pump, and it comprises means for ensuring that it is closed off when the pusher is raised, in the rest position.

In the case of a simple rigid bottle, with or without a scraper piston, the air circuit may be formed by a vent, preferably in the bottom of the bottle.

Thus, according to one advantageous embodiment, in the bottom of the rigid bottle there is a vent provided with a valve, in order to avoid any leakage of the product contained in the bottle, and with a filter for preventing the ingress of contaminants, such as bacteria, which could degrade the product to be dispensed.

In the variant that includes a vent in the bottom of the bottle, it is preferable to provide a dip tube that extends the pump into the bottle, the end of the dip tube possibly being located near the bottom of the bottle.

To ensure proper sealing of the assembly, formed by the bottle, the pump and optionally the flexible pouch, including in situations in which this assembly would be in a region of pressure low enough to be able to cause the two valves to open, in the case of identical valves, and of causing the product contained in the metering chamber and in the bottle to leak, a cap or cover may be removably mounted on the dispensing head.

Means may be provided for ensuring that a seal is formed by the fitting arrangement between the cover and the head, for example the cover may be put into place by snap-fitting it thanks to shape complementarity between the internal edge of the cover and the base of the pusher nose receiving it, this fitting arrangement being supplemented with an O-ring seal or with sealing beads.

Such an accessory supplementing the pump and its pusher ensures that there is excellent sealing under all storage conditions, even when the external pressure drops, and allows the product contained in the bottle to be preserved.

The pump according to the present invention has the advantage of comprising only a limited number of components, thereby reducing the manufacturing costs.

Thus, the pump of the invention comprises only five or six components, depending on the configuration adopted. In addition, the lower (intake) and upper (expulsion) valves may be identical, thereby further reducing the tools needed for manufacturing them. For comparison, the pumps commonly used in the art for bottles with a flexible pouch for cosmetic or pharmaceutical products generally comprise between 15 and 20 components.

The pump is generally made of a plastic, such as polyethylene or polypropylene of suitable density so as to give it the required mechanical properties.

The pouch may be made of a plastic selected for example from a polyethylene, a polypropylene, a polyamide, an ethylene/vinyl alcohol copolymer (EVOH), a low-density polyethylene, etc. It may comprise monolayer materials or multilayer complexes that include a metal layer, for example an aluminum layer forming a barrier that enhances the sealing, combined with one or more plastic layers.

The pouch may be manufactured from these materials by techniques such as blow molding as a single part, which has the advantage of reducing the necessary manufacturing investment. It may also be produced by the injection-blow molding or extrusion-blow molding of a parison in a suitable mold. The pouch may also be manufactured by welding a plastic or metal film, or a metal/plastic multilayer complex, onto a support forming the neck of the pouch.

It may be advantageous to produce the pouch from a material matched to the product that it contains. Thus, as an example, the pouch may be made of low-density polyethylene when it has to contain a cream insensitive to the effects of the external environment, whereas it may be made of a polyamide, providing better protection against the effects of oxygen and against the loss of water vapor by evaporation when it has to contain a more delicate product.

Figure 2A:
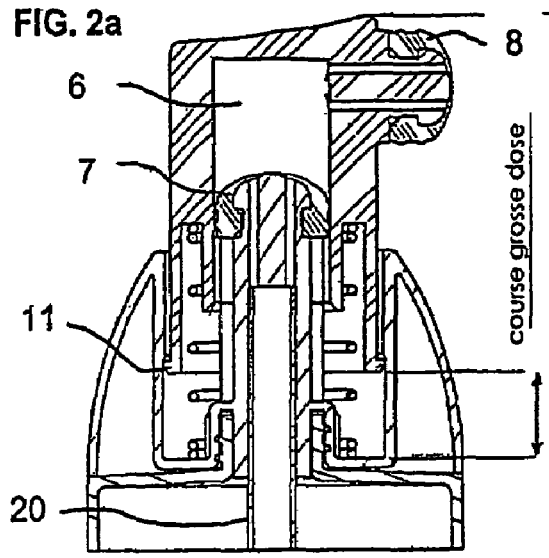
Figure 2B:
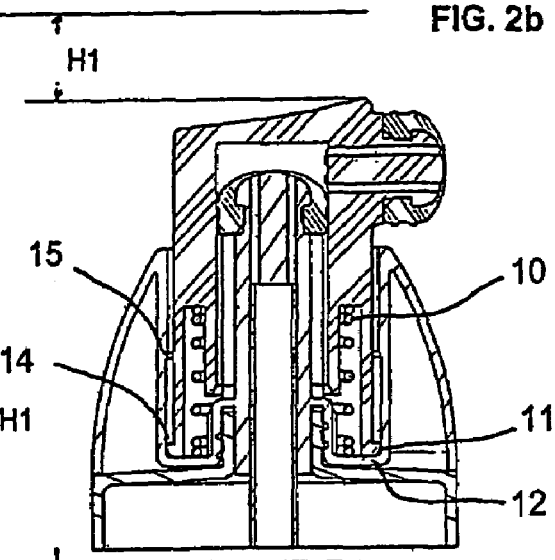
Figure 3A:
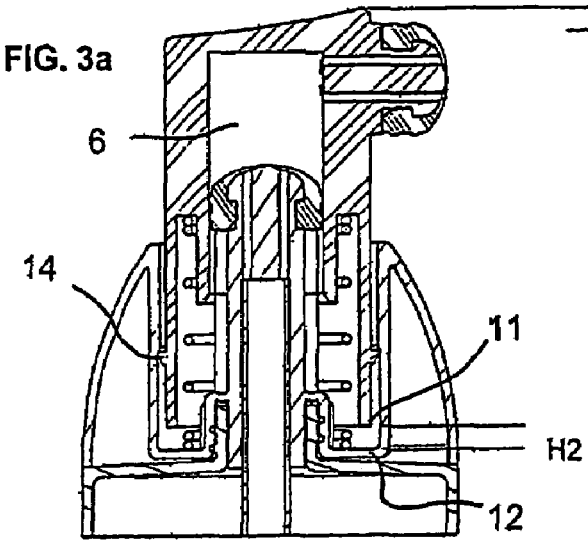
Figure 3B:
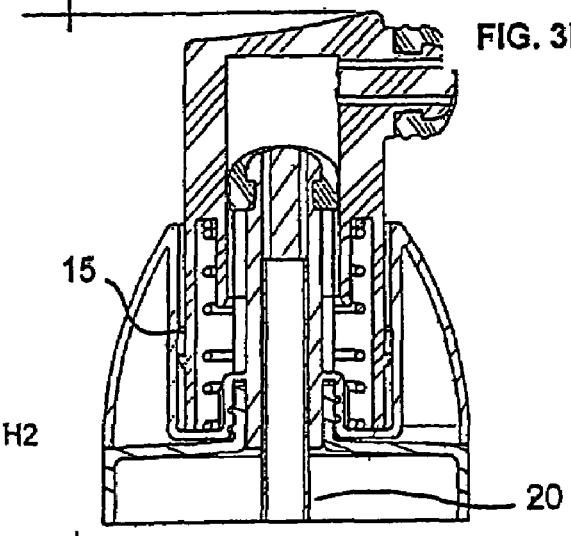
Figure 4A:
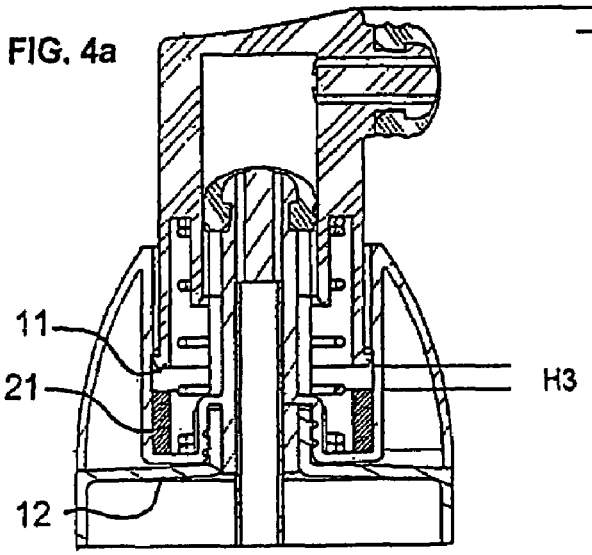
Figure 4B:
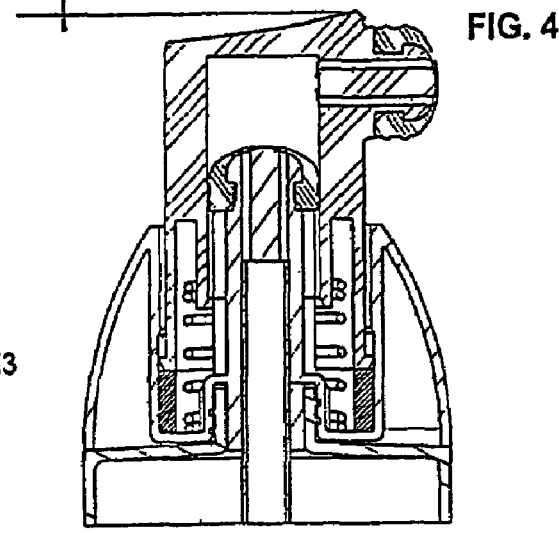
Figure 5:
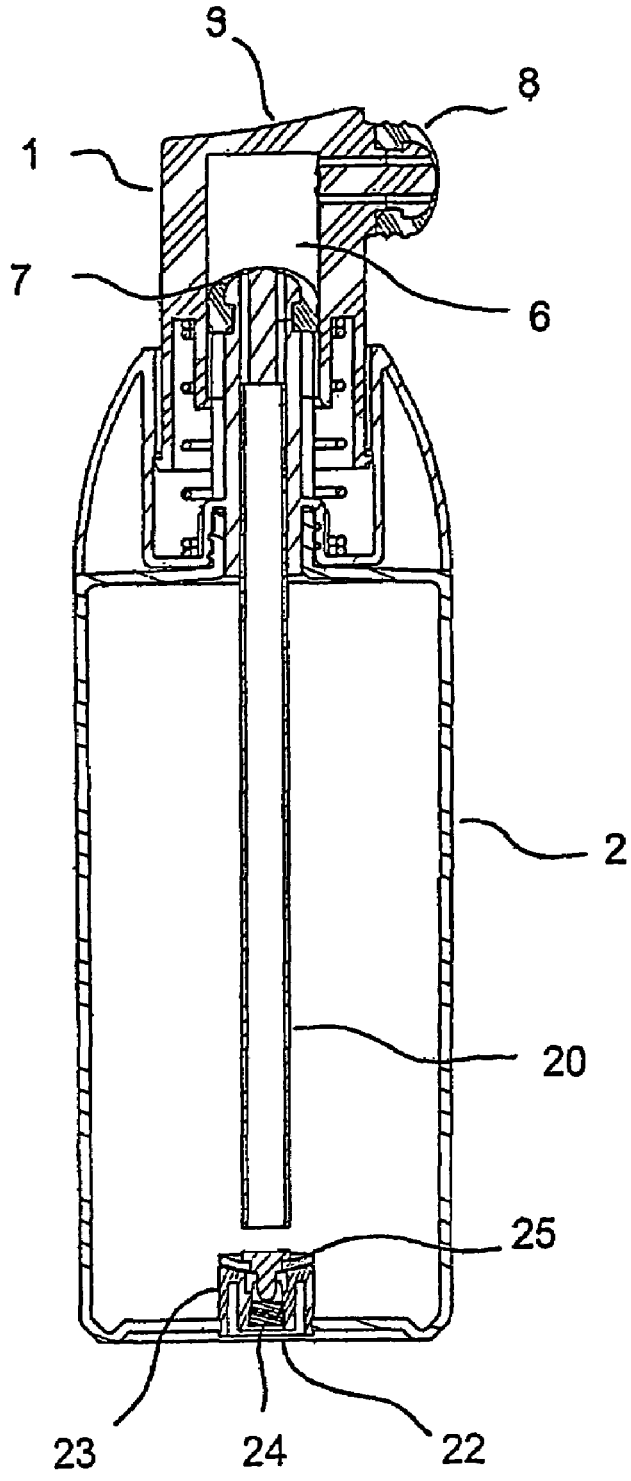
FIG. 5 shows a sectional view of an alternative version of the device of FIG. 1.
Figure 6:
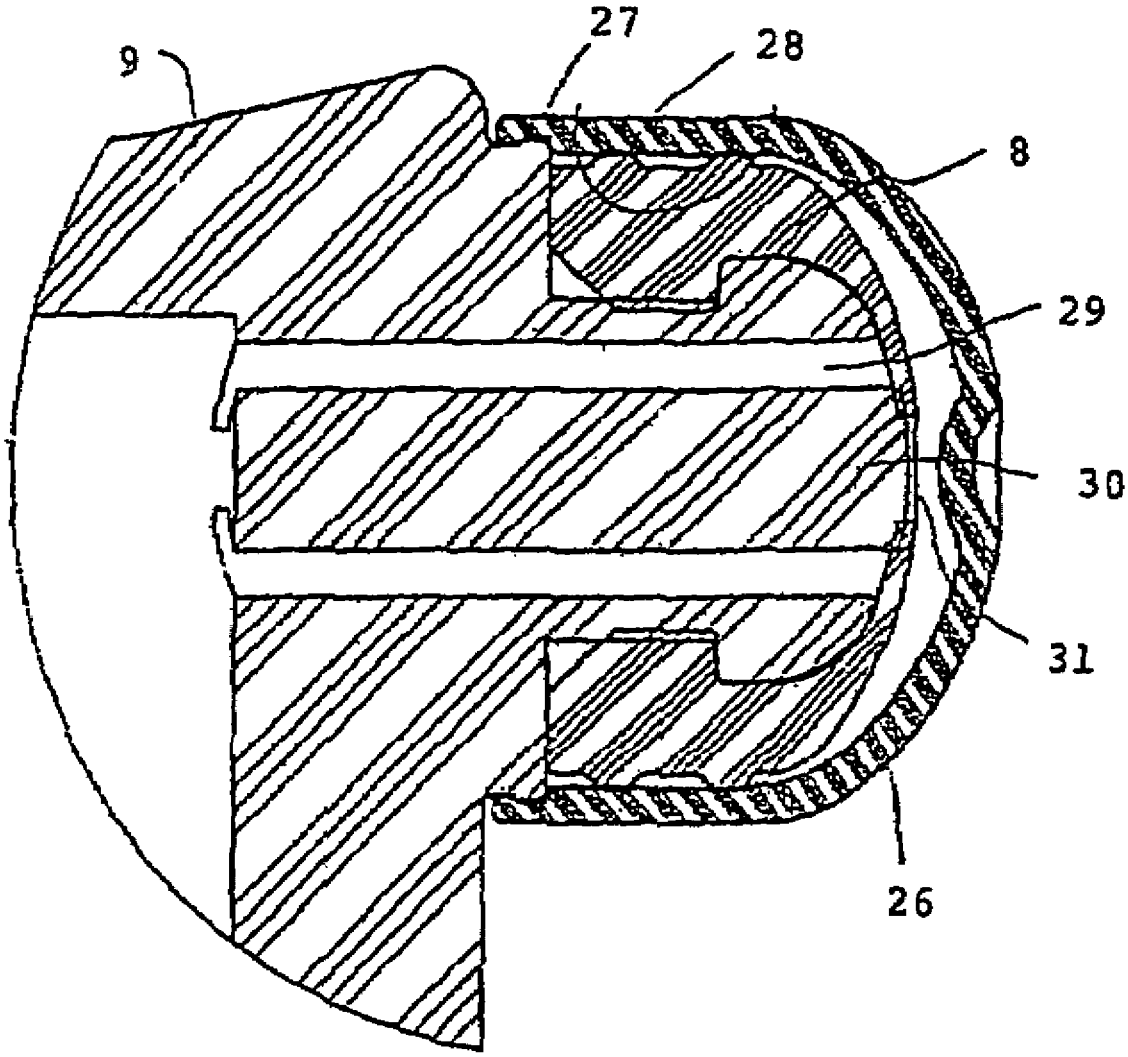
FIG. 6 shows an enlarged sectional view of the dispensing nose of a pusher.
Figure 7:
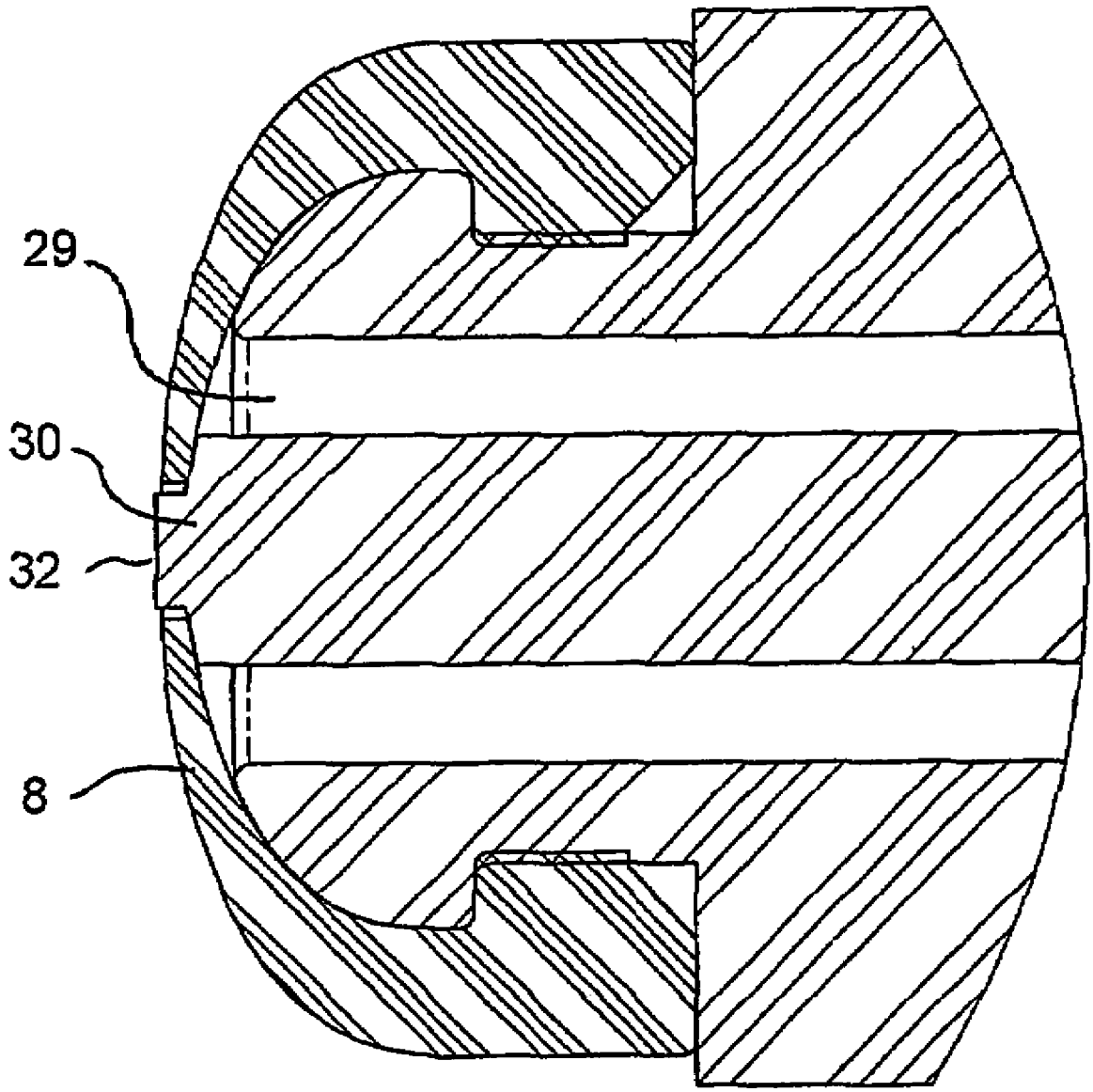
FIG. 7 shows an enlarged sectional view of an alternative embodiment of the pusher of FIG. 6.

The advantages and features of the pump according to the present invention will become apparent in the non-limiting illustrative examples described in greater detail below, with reference to the appended drawings which show:

FIG. 1: a schematic sectional view of a pump mounted on the neck of a rigid container, presented in the rest position with the pusher raised;

FIGS. 2*a* and 2*b:* a partial sectional view of a device for dispensing fluid, liquid or pasty products, comprising a pump as shown in FIG. 1 mounted on a simple bottle, the pusher being in the high position (FIG. 2*a*) or in the low position (FIG. 2*b*);

FIGS. 3*a* and 3*b:* a partial sectional view of an alternative version of the device of FIG. 2 in which the pusher, in the high position in FIG. 3*a* and in the low position in FIG. 3*b,* is designed to expel a small dose of product;

FIGS. 4*a* and 4*b:* a partial sectional view of another alternative version of the device of FIG. 2 in which the travel of the pusher, in the high position shown in FIG. 4*a* and in the low position shown in FIG. 4*b,* is limited by a sleeve;

FIG. 5: a sectional view of an alternative version of the device of FIG. 1, comprising a dip tube and a vent at the bottom of the bottle;

FIG. 6: an enlarged sectional view of the dispensing nose of the pusher carrying a sealed closure cap; and FIG. 7: an enlarged sectional view of an alternative embodiment of the pusher of FIG. 6.

The pump (1) shown in FIG. 1 is mounted on the body (2) of a rigid bottle via a cap (3). For this purpose, the cap (3) has a cylindrical hole (4) in which the body (5) of the pump (1) is housed so as to be able to slide therein.

The chamber (6) of the pump (1) is bounded by the lower valve (7), or intake valve, and the upper valve (8), or expulsion valve. The two valves (7) and (8) are identical but mounted in opposition, as indicated below, that is to say the intake valve closes when the expulsion valve opens, and vice versa, depending on the movements of the pump. As FIG. 1 shows, the upper valve (8) is mounted on the end of the outlet nozzle of the pump.

The upper portion of the body of the pump has the form of a pusher (9) allowing the user to actuate the pump from the position shown in FIG. 1, by pressing down the pusher (9) against the metal helical spring (10) placed on the outside of the chamber, in such a way that it does not come into contact with the product leaving the pouch. In this movement, the body of the pump slides in the cylindrical hole (4) of the cap (3) until the lower end (11) of the body (5) of the pump bears against the flange (12) integral with the tube (13) carrying the lower valve (7).

In this descending movement of the pusher (9), the lower valve (7) remains closed, while the upper valve (8) is open, allowing the product in the chamber (6) to leave.

When the user releases the pressure on the pusher (9), the body (5) of the pump (1) rises under the action of the spring (10) until the circular retainer (14) comes into contact with the stop (15) formed on the internal wall of the cylindrical hole (4) in the cap (3).

In this ascending movement of the pusher (9), the upper valve (8) remains closed, while the lower valve (7) is open, allowing the product in the pouch (16) to enter the chamber (6).

The pouch (16) is fixed via its neck (17) to the base of the tube (13) and rests on the shoulder (18) formed on the body (2) of the bottle. The neck (17) may be fixed to the tube (13) by ultrasonic welding. The small size of the neck (17) of the pouch, i.e. less than one third of the cross section of the bottle, facilitates its manufacture by a simple blow molding technique.

Since the pump is sealed and fixed to the neck (17) of the pouch (16), an air inlet circuit is provided so that the external air can enter the space separating the pouch from the inner wall of the bottle so as to maintain a sufficient pressure therein for the pouch to be able to retract at each expulsion of product. This air circuit is formed by the space between the outer portion of the body (5) and the internal wall of the cylindrical hole (4), forming a channel that allows the air to pass between the walls of the pump and the cylindrical hole. This channel is open when the pusher is actuated, and it is closed when the pusher is raised since, in this position, the annular rib (19) bears against the edge of the cylindrical hole (4) and closes off the channel.

The trials carried out with a device as shown in FIG. 1, comprising a pump according to the invention, have demonstrated excellent uniformity of metering, and a reproducibility of around 90 to 95% in the case of creams, depending on their viscosity, and greater than 95% in the case of liquids.

In addition, when used for the first time, the pump may be primed by pressing just three or four times on the pusher.

FIG. 2 shows the pump of FIG. 1 mounted in a sealed manner on a simple rigid bottle for fluids, preferably for liquids, in which the pump is extended in the bottle by a dip tube.

The pusher of the pump of FIG. 2*a* is in the high position and the circular retainer (14), located at the base of the pusher, is then in contact with the shoulder forming stop (15) on the internal face of the cylindrical hole that receives the pusher. When the user presses the pusher against the compression spring (10), the base (11) of the pusher comes against the flange (12) forming the bottom of the cylindrical hole (4) as shown in FIG. 2*b.* The travel H1 of the pusher is indicated in FIG. 2*a* and is equal to the distance separating the flange (12) from the base (11) of the pusher in the raised position.

The descending movement of the pusher causes the valve (8) to open and the product lying in the metering chamber (6) to be expelled, while the intake valve (7) remains closed under the action of the overpressure in the chamber.

When the user then releases the pusher, this rises under the action of the spring (10) and the partial vacuum thus created in the chamber (6) causes the intake valve (7) to open and the product coming from the bottle to enter via the dip tube (20), while the upper valve (8) remains closed. The metering chamber (6) thus fills up with a dose of product, which is ready to be expelled when the user next actuates the pusher. This dose of product remains protected from the external air thanks to the sealing of the upper valve (8). In addition, because of the position of the upper valve (8), no residual amount of product remains in contact with the external atmosphere thereby limiting the risk of the outlet orifice being blocked by accumulation of material.

In the embodiment shown in FIG. 3*a,* the cylindrical base of the pusher is extended beyond the circular retainer (14), and the height H2 separating the base (11) of the pusher from the bottom (12) of the flange is then shorter. The travel of the piston is limited to the height H2 so that the pressure on the pusher causes only the expulsion of a partial dose from the chamber (6).

An equivalent embodiment is shown in FIG. 4*a,* in which the pusher (9) is identical to that of FIG. 2*a* but its travel is limited by a cylindrical ring (21) placed in the bottom of the cylindrical hole, on the base of the flange (12). The travel H3 of the pusher is then equal to the travel H1 of the device of FIG. 2*a,* reduced by the height of the cylindrical ring (21).

FIG. 5 shows a rigid bottle (2) carrying the pump (1) of the invention, which includes the two valves (7) and (8) and the pusher (9). The bottle (2) is supplemented with a venting system (22).

The venting system comprises a plug (23) inserted into a hole provided in the bottom of the bottle (2) and carrying a filter (24) and a valve (25) of the usual type. The valve is designed so as to let the external air enter the bottle only when a partial vacuum forms in the latter, that is to say when a dose of product is drawn up via the dip tube (20) of the bottle into the metering chamber (6).

Thus, air is introduced into the bottle (2) at each actuation of the pusher (9) of the pump (1) in order to compensate for the volume of the dose expelled, without contaminating the product contained in the bottle, thanks to the filter (24).

FIG. 6 shows a detail of the upper valve (8) carrying a shroud (26) mounted in a sealed manner on the nose of the pusher (9). Sealing is achieved by means of a rib (27) that cooperates with the base of the cylindrical shroud (26) made of an elastic material. Further sealing is achieved by the ribs (28) formed on the cylindrical base of the upper valve (8). The shroud (26) thus completely envelopes the valve (8), ensuring that the device is closed off in a sealed manner.

As shown in FIG. 6, the product outlet nozzle comprises an annular orifice (29) surrounding a cylindrical element (30) lying opposite the hole (31) formed in the front face of the valve (8). In the closure position, the front face of the valve (8) is applied against the cylindrical element (30) and masks the annular orifice (29). Because of the flexibility and elasticity of the material constituting the valve (8), an overpressure in the duct of the orifice (29) causes the edge of the valve around the central hole (31) to move away, letting the product leaving the metering chamber (6) to pass. The sealed shroud (26), by masking the nose of the pusher (9), prevents any drop in external pressure from causing the same phenomenon, and therefore ensures that the product contained in the bottle is safely stored.

In the alternative embodiment shown in FIG. 7, the cylindrical element (30) along the axis of the annular orifice (29) includes, on its front face, a cylindrical protuberance (32) of the same axis as the cylindrical element (30). This protuberance forms with the front face of the cylindrical element a shoulder that cooperates with the edge of the central orifice of the valve (8), in such a way that the front surface of the cylindrical protuberance (32) is in the extension of the surface of the valve (8).

This embodiment allows the flow of fluid leaving the orifice (29) to be guided, even if the edges of the valve do not rise perfectly symmetrically with respect to the axis of the annular orifice (29).

The invention claimed is:

1. A manually actuated metering pump for a rigid bottle, of a double-valve type, comprising an intake lower valve and an expulsion upper valve at an inlet and at an outlet, respectively, of a metering chamber that is mounted so as to slide on the lower valve, wherein the lower valve and the upper valve are identical, the metering pump is mounted on a neck of a flexible pouch placed in the rigid bottle and includes an air inlet circuit for air to enter space separating the flexible pouch from an inner wall of the rigid bottle, and the air inlet circuit is located level with a pusher of the pump, and comprises means for ensuring that the air inlet circuit is closed off when the pusher is raised, in a rest position.

2. The metering pump as claimed in claim 1, wherein the valves are of cylindro-conical shape, comprising a dome pierced at its center, the wall of the valves, in a closure position, covers an annular outlet orifice.

3. The metering pump as claimed in claim 1, wherein the lower valve is fixed to a hollow tube that communicates with an inside of the bottle.

4. The metering pump as claimed in claim 1, wherein the upper valve is mounted on an end of the outlet of the pump and constitutes an outermost closure.

5. The metering pump as claimed in claim 1, wherein the valves are made of a material having a Shore A hardness of between 40 and 80.

6. The metering pump as claimed in claim 1, further comprising means for limiting travel of the pusher.

7. A device for packaging and dispensing fluid, liquid or pasty products, comprising a metering pump as claimed in claim 1, associated with the rigid bottle.

* * * * *